US006179731B1

(12) United States Patent
Shimosaka et al.

(10) Patent No.: US 6,179,731 B1
(45) Date of Patent: Jan. 30, 2001

(54) GOLF BALL

(75) Inventors: Hirotaka Shimosaka; Atsuki Kasashima; Keisuke Ihara, all of Chichibu (JP)

(73) Assignee: Bridgestone Sports Co., Ltd., Tokyo (JP)

( * ) Notice: Under 35 U.S.C. 154(b), the term of this patent shall be extended for 0 days.

(21) Appl. No.: 09/179,840

(22) Filed: Oct. 28, 1998

(30) Foreign Application Priority Data

Oct. 28, 1997 (JP) ..... 9-311281

(51) Int. Cl.[7] ..... A63B 37/14
(52) U.S. Cl. ..... 473/384; 473/378; 473/383
(58) Field of Search ..... 473/378–384; 273/232

(56) References Cited

U.S. PATENT DOCUMENTS 922,773 * 5/1909 Kempshall ..... 473/383
1,418,220 * 5/1922 White ..... 473/384
5,916,044 * 6/1999 Shimosaka et al. ..... 473/377

FOREIGN PATENT DOCUMENTS

27583 * 11/1912 (GB) ..... 273/232
2215621 * 9/1989 (GB) ..... 273/232

* cited by examiner

*Primary Examiner*—Benjamin H. Layno
(74) *Attorney, Agent, or Firm*—Sughrue, Mion, Zinn, Macpeak & Seas, PLLC

(57) ABSTRACT

A golf ball having a spherical surface is provided. When an imaginary circle with a radius of 5 mm is traced on the spherical surface and centered at any point on that surface, 3–25 raised projections of at least two types which are different in diameter and/or height and 0.01–0.30 mm high are contained in the circle, or raised projections of at least one type and 0.01–0.30 mm high and recessed dimples of at least one type are contained in a total number of 3–25 in the circle. The ball follows a straight trajectory and has an increased run and total distance of travel.

11 Claims, 6 Drawing Sheets

GOLF BALL

BACKGROUND OF THE INVENTION

1. Field of the Invention

The present invention relates to a golf ball which follows a straight trajectory and has a good run and an increased total distance of travel.

2. Prior Art

Golf balls have hitherto been provided on the surface with numerous planar circular depressions, or recessed dimples, in order to enhance their aerodynamic properties. It is well known that, other factors being equal, golf balls with projections fly better than golf balls which are smooth and lack dimples.

When a full shot with a driver is taken with a dimpled golf ball, friction with the club head causes the ball to spin, which tends to lower the launch angle. To increase the distance traveled by the ball, the spin must be reduced so as to afford a higher launch angle.

Golf balls are manufactured in accordance with the Rules of Golf, which are the same throughout the world. The Rules hold that a regulation ball, meaning an official tournament ball, must have a ball diameter of not less than 42.67 mm (large-size ball).

However, a ball with a greater diameter has a larger cross-sectional surface area which, when subjected to the influence of the wind, results in a steeper angle of descent. This shortens the run of the ball after it lands and the total distance traveled. In addition, the trajectory is more likely to deviate laterally.

SUMMARY OF THE INVENTION

The object of the present invention is thus to provide a golf ball which reduces spin, achieves a high launch angle and a straight trajectory, and has a good run and an increased total distance of travel.

To attain this object, the invention provides a golf ball having a substantially spherical surface. It is assumed that an imaginary circle with a radius of 5 mm is traced on the spherical surface and centered at any point on that surface. In a first embodiment, 3 to 25 raised projections of at least two types which are different in diameter and/or height and at least 0.01 mm high are contained in the circle.

In a second embodiment, raised projections of at least one type and at least 0.01 mm high and recessed dimples of at least one type are contained in a total number of 3 to 25 in the imaginary circle.

In the golf ball of this invention, the raised projections preferably account for at least about 30% of the surface area of the imaginary circle. Moreover, these raised projections, when projected onto the spherical surface, preferably have planar shapes which are circular and 1 mm to 4.2 mm in diameter, and preferably have a total projected surface area that accounts for 30 to 90% of the overall surface area of the golf ball. The golf ball of the invention typically has a surface hardness of 50 to 70 in Shore D. The spherical surface serves as land areas around the raised projections, and the ball preferably has a land diameter of not more than 42.66 mm.

In the inventive golf ball, from 3 to 25 raised projections of at least two types which are different in diameter and/or height and at least 0.01 mm high are encompassed in an imaginary circle with a radius of 5 mm traced on its spherical surface and centered at any point thereon, or raised projections of at least one type and at least 0.01 mm high and recessed dimples of at least one type are encompassed in a total number of 3 to 25 in the same imaginary circle. Preferably, the ball is provided with numerous raised projections such that the ratio of the total projected surface area when these projections are projected onto the ball's spherical surface to the overall surface area of the golf ball (sometimes referred to herein as the "raised projection coverage") is 30 to 90%. With this construction, when a full shot with a driver is taken of the ball, the surface area of contact with the club head is much smaller. This enables a high launch angle and low spin rate to be achieved, resulting in a very long run and thus a significant increase in the total distance traveled by the ball.

Moreover, the large number of raised projections provided on the golf ball of this invention enable the diameter requirement for large-size balls to be satisfied while allowing the ball to essentially have a smaller diameter which leaves it less subject to influence by the wind and gives it straighter flight characteristics.

However, since raised dimples and recessed projections are alike other than being raised or recessed with respect to the spherical surface, it is convenient herein to treat both as falling under the concept of a dimple.

The objects, features and advantages of the invention will become more apparent from the following detailed description.

DETAILED DESCRIPTION OF THE INVENTION

According to the invention, by providing a large number of raised projections on the spherical surface of a golf ball, the surface area of contact with the club head upon a full shot with a driver is decreased. This has the effect of lowering the spin rate, resulting in a higher launch angle and a greater total distance.

First embodiment

In the inventive golf ball, when an imaginary circle with a radius of 5 mm is traced on the ball's spherical surface and centered at any point on that surface, from 3 to 25, preferably from 3 to 12, and more preferably 4 to 8, raised projections are contained in the circle. Fewer than 3 raised projections results in a large variability in the launch angle, spin rate, and initial velocity when the ball is struck, whereas more than 25 raised projections adversely affect the lift-drag characteristics thereof so that the ball flies less well. The containment of projections "in an imaginary circle with a radius of 5 mm" signifies that at least half of the surface area of the respective projections lies in a circle with a radius of 5 mm.

The raised projections preferably occupy at least about 30%, and more preferably about 50 to 90%, of the surface area of the imaginary circle. If the raised projections occupy less than about 30% of the imaginary circle, the ball would be hit at a largely varying launch angle, spin rate and initial velocity. Any point on the spherical surface of the ball may serve as the center of the imaginary circle having a radius of 5 mm. For example, this may even be a point near the poles or near the equator of the ball.

Figure 1:
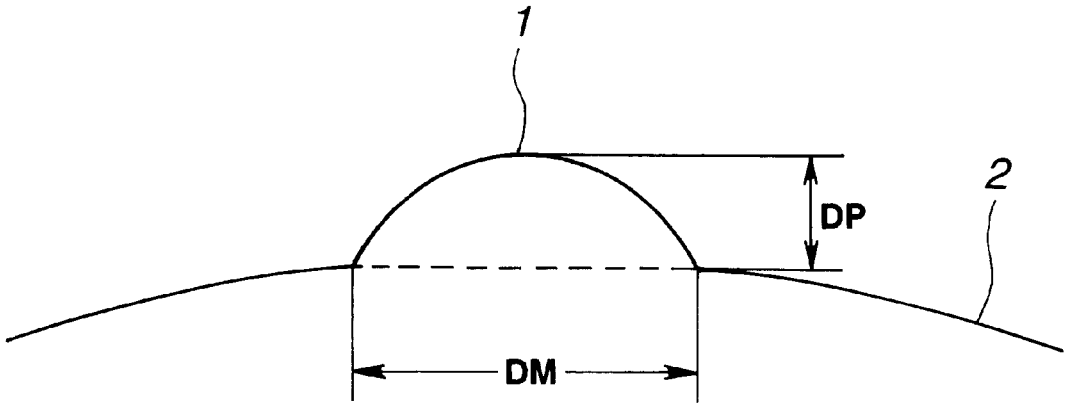
FIG. 1 is an enlarged view of a raised projection on the surface of a golf ball according to the invention.

Referring to FIG. 1, one raised projection is depicted at 1 on the spherical surface 2. The raised projection 1 has a height DP of at least 0.01 mm, and preferably 0.05 to 0.30 mm. When the height of the raised projection is less than 0.01 mm, the difference with the land areas becomes too insignificant for the desired effects of the invention to be achieved. Moreover, it is preferred that the raised projections be circular in planar shape, when projected onto the spherical surface of the golf ball. The circular raised projections preferably have a diameter DM of 1 mm to 4.2 mm, and more preferably from 2.0 to 3.8 mm. It is also preferred that the raised projections be of at least two types, and especially two to four types, which are different in diameter and/or height. The total number of raised projections (which is equal to the total number of dimples if all dimples are raised ones) is generally from 180 to 600, preferably from 372 to 550. No particular limit is imposed on the arrangement of these raised projections. For example, use may be made of known arrangements which are employed for the recessed dimples.

The ratio of the total projected surface area of the raised projections when projected onto the spherical surface of the golf ball to the overall surface area of the ball (raised dimple coverage) is preferably 30 to 90%, and more preferably 50 to 85%. If the total projected surface area is less than 30%, the ball would be hit at a largely varying launch angle, spin rate, and initial velocity. A total projected surface area of greater than 90% would adversely affect the lift-drag characteristics, causing the ball to fly less well.

Second embodiment

In the golf ball according to the second embodiment, when an imaginary circle with a radius of 5 mm is traced on the ball's spherical surface and centered at any point on that surface, both raised projections of at least one type and at least 0.01 mm high and recessed dimples of at least one type are contained in the circle. The total number of raised and recessed dimples in the circle is from 3 to 25, preferably from 3 to 12, and more preferably 4 to 8. The objects of the invention are more effectively achieved by the interdispersion of projections raised and recessed dimples in a suitable proportion.

The raised projections are of at least one type, preferably one to four types, the number of raised projections is preferably 2 to 24, more preferably 2 to 11 in the circle, and the diameter and height of raised projections are as defined in the first embodiment. On the other hand, the recessed dimples are of at least one type, preferably one to three types, the number of recessed dimples is preferably 1 to 12, more preferably 1 to 3 in the circle, and the recessed dimples usually have a diameter of 1.5 to 3.6, preferably 2.0 to 3.6 mm and a depth of 0.08 to 0.20 mm. Areas of recessed dimples account for preferably 5 to 40%, more preferably 7 to 15% of the areas of the raised and recessed projections combined on the ball's surface. The remaining parameters are the same as in the first embodiment.

The following description is common to the first and second embodiments.

Because the golf ball of this invention preferably has a diameter in the land areas of not more than 42.66 mm, and especially 42.3 to 42.6 mm, it satisfies the diameter specification for large-size balls while allowing the diameter of the ball to be essentially smaller than this.

More particularly, even if the ball's "land diameter" (defined herein as the distance, through the center of the ball, from one point on a land area to a point on a land area on the opposite side of the ball; this distance is the diameter of the ball when there are no recessed dimples on the surface) has been made smaller, as in the range mentioned above, than the diameter specified for large-size balls, the ball diameter (defined herein as the distance, through the center of the ball, from the peak of one raised projection to the peak of a raised projection on the opposite side of the ball) is not less than 42.67 mm, and preferably 42.68 to 42.80 mm, because a large number of raised projections are provided on the spherical surface of the ball. Accordingly, the ball can be made to satisfy the diameter specification for large-size balls while essentially having a diameter that is smaller, thereby reducing the cross-sectional surface area of the ball so that it is less subject to influence by the wind and able to achieve straighter flight characteristics.

So long as the golf ball of the invention is provided with the features described above, other constituent elements and features of the ball are not subject to any particular limitations. The art disclosed herein may thus be applied to all types of golf ball, including solid golf balls such as one-piece golf balls, two-piece golf balls, and multi-piece golf balls having three or more layers, as well as thread-wound golf balls.

The surface hardness of the inventive golf ball (generally the surface hardness of the cover, although this refers to the surface hardness of the ball itself in one-piece golf balls) is typically in a range of 50 to 70 Shore D, and especially a range of 58 to 68 Shore D.

The golf ball according to the present invention can be manufactured from known materials by a conventional method. Weight and other characteristics of the ball may be set as appropriate under the Rules of Golf.

EXAMPLE

Examples of the invention are given below by way of illustration, and are not intended to limit the invention.

Examples 1–2 and Comparative Example

A rubber composition of the following composition was kneaded in a roll mill, then molded under applied pressure at 155° C. for 15 minutes to form a solid core having a diameter of 38.5 mm.

| Rubber Composition: | Parts by weight |
|---|---|
| cis-1,4-Polybutadiene | 100 |
| Zinc acrylate | 24 |
| Zinc oxide | 19 |
| Antioxidant | 1 |
| Dicumyl peroxide | 1 |

Cover stock composed primarily of an ionomer resin and having a Shore D hardness of 64 was injection molded about the core to form a cover having a thickness of 2.1 mm. Two-piece solid golf balls of Examples 1 and 2 and of Comparative Example were molded in this way.

Figure 2:
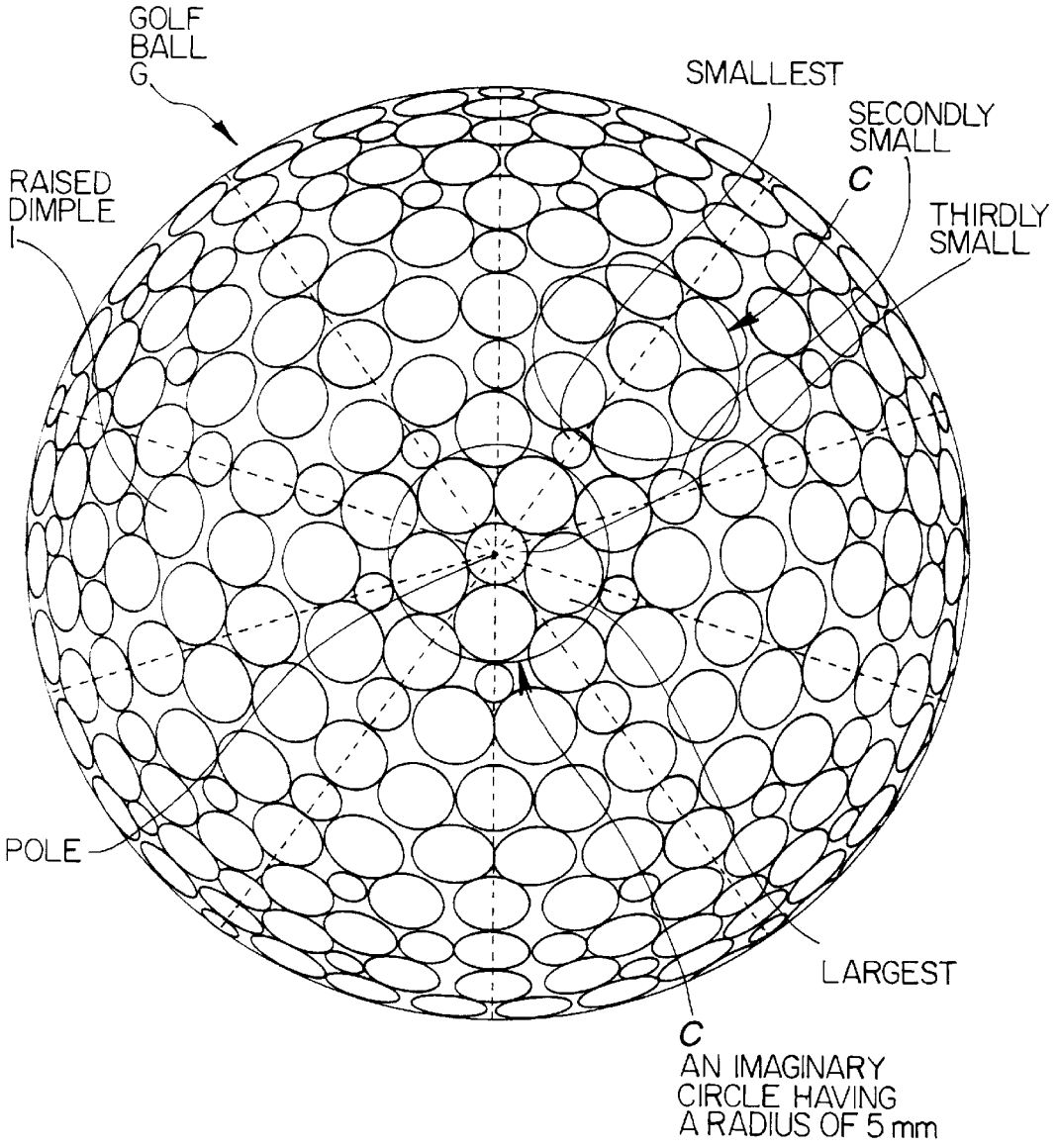
FIG. 2 shows the dimple pattern, as seen from the polar direction, on both the golf ball of Example 1 according to the invention and the golf ball of the comparative example.
Figure 3:
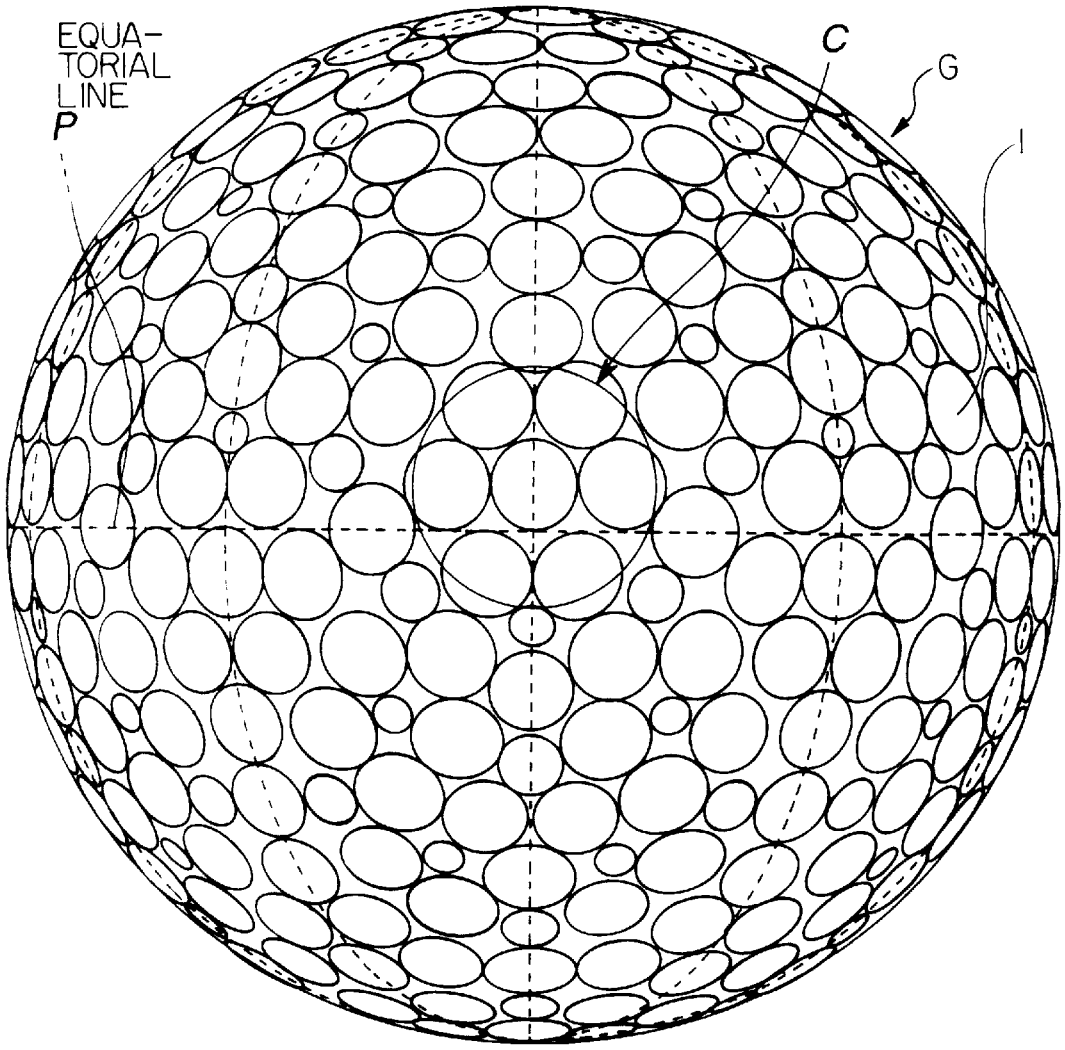
FIG. 3 shows the dimple pattern on the same ball, as seen from the equatorial direction.

The golf ball in Example 1 had the four types of raised projections described in Table 1 distributed on the surface in the dimples arrangement shown in FIGS. 2 and 3. Here, FIG.

2 is a plan view as seen from the polar direction, and FIG. 3 is a plan view as seen from the equatorial direction.

Figure 4:
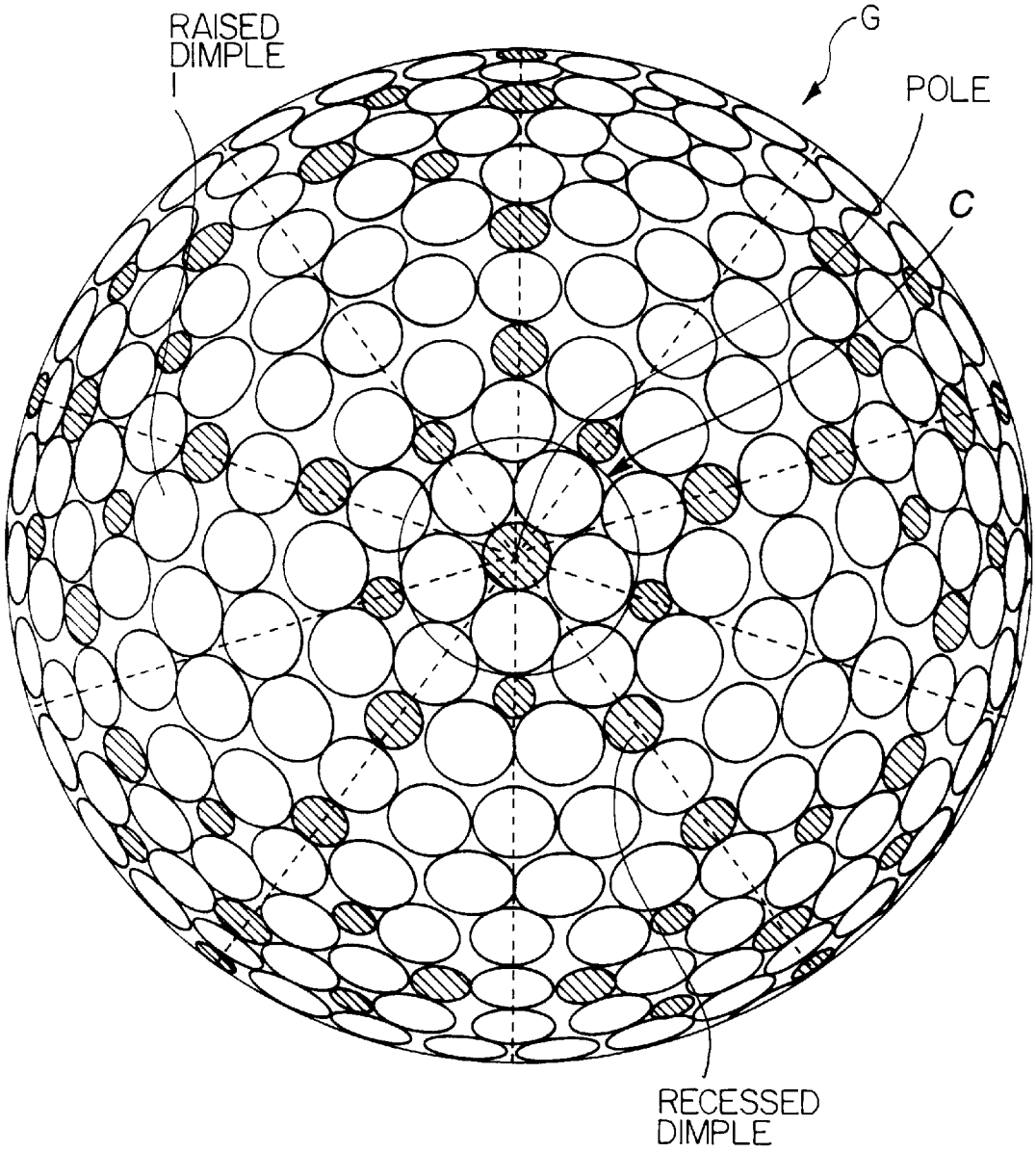
FIG. 4 shows the projection pattern, as seen from the polar direction, on the golf ball of Example 2.

The golf ball in Example 2 had the one type of raised projection and the three types of recessed projections described in Table 2 distributed on the surface in the arrangement shown in FIG. 4. FIG. 4 is a plan view, as seen from the polar direction, in which the recessed dimples are shaded.

The golf ball in Comparative Example had the four types of recessed dimples described in Table 3 distributed on the surface in the dimples arrangement shown in FIGS. 2 and 3, which is the same arrangement as on the golf ball in Example 1.

In FIGS. 2 to 4, C represents an imaginary circle having a radius of 5 mm on the surface of the golf ball.

TABLE 1

| | Example 1 | | | |
|---|---|---|---|---|
| Dimple diameter (mm) | 3.6 | 2.7 | 2.4 | 1.7 |
| Number of dimples | 390 | 12 | 60 | 60 |
| dimple/projection shape | raised | raised | raised | raised |
| Dimple height (mm) | 0.17 | 0.14 | 0.13 | 0.11 |
| Diameter of ball land (mm) | 42.51 | | | |
| Raised dimple coverage (%) | 78 | | | |

TABLE 2

| | Example 2 | | | |
|---|---|---|---|---|
| Dimple diameter (mm) | 3.6 | 2.7 | 2.4 | 1.7 |
| Number of dimples | 390 | 12 | 60 | 60 |
| dimple/projection shape | raised | recessed | recessed | recessed |
| Dimple height or depth (mm) | 0.17 | 0.12 | 0.10 | 0.10 |
| Diameter of ball land (mm) | 42.51 | | | |
| Raised dimple coverage (%) | 70 | | | |

TABLE 3

| | Comparative Example | | | |
|---|---|---|---|---|
| Dimple diameter (mm) | 3.6 | 2.7 | 2.4 | 1.7 |
| Number of dimples | 390 | 12 | 60 | 60 |
| Dimple/projection shape | recessed | recessed | recessed | recessed |
| Dimple depth (mm) | 0.16 | 0.12 | 0.10 | 0.10 |
| Diameter of ball land (mm) | 42.69 | | | |
| Raised dimple coverage (%) | 0 | | | |

The flight performance and spin characteristics of the golf balls were measured as described below. The results are given in Table 4.

When the golf balls were each inspected for diameter using a ring gauge having an inside diameter of 42.67 mm, none of the balls passed through the ring gauge.

Flight Performance and Spin Characteristics:

The balls were hit with a driver at a head speed of 45 m/sec using a swing robot (Miyamae K.K.). The initial velocity, launch angle, spin rate, carry, total distance, and flight time were measured. The club used and the method of striking the ball are described below. Measurements of the launch angle and spin rate were carried out with a Science Eye golf club testing system (Bridgestone Sports Co., Ltd.).

(1) Club:

Head: J's Metal (Bridgestone Sports Co., Ltd.)

Loft angle, 9.5°

Lie angle, 57°

Manufactured from SUS630 stainless steel by lost wax process

Shaft: Harmotec Pro HM-70 LK (low kick point)

Figure 5:
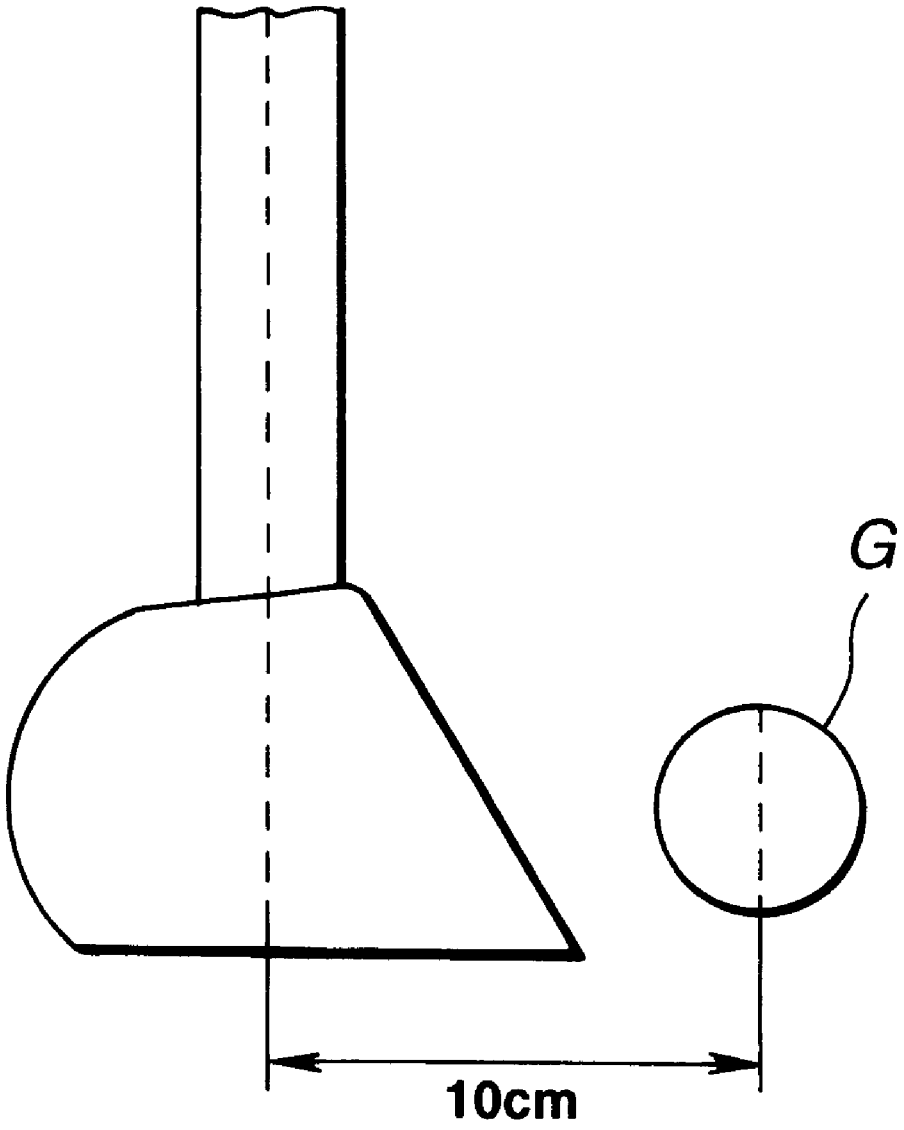
FIG. 5 is a diagram illustrating the manner in which the golf ball is hit.
Figure 6:
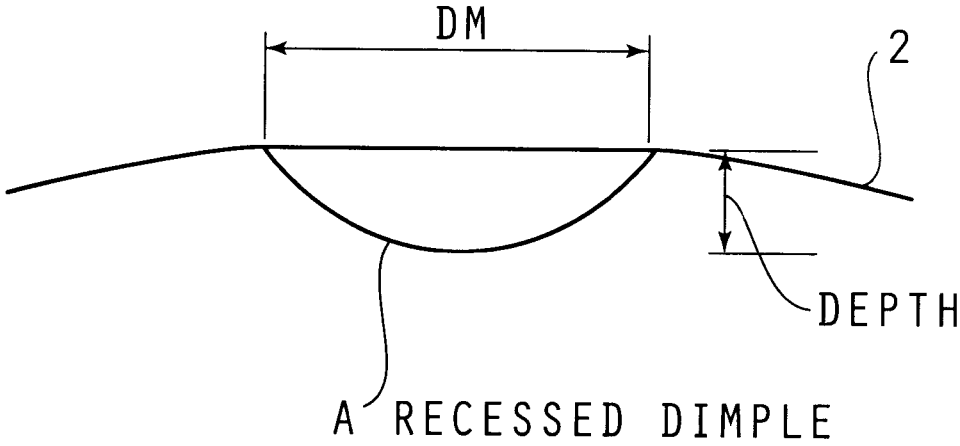
FIG. 6 is an enlarged view of a recessed dimple on the surface of a golf ball according to the invention.

Hardness, X (2) Method of Striking Ball:

The foregoing club was set in the swing robot and the ball was placed 10 cm in front of the position where the shaft hangs down vertically (see FIG. 5) before the ball was struck.

TABLE 4

| | Example 1 | Example 2 | Comparative Example |
|---|---|---|---|
| Initial velocity (m/sec) | 65.2 | 65.2 | 65.3 |
| Launch angle (°) | 11.5 | 11.7 | 10.8 |
| Spin rate (rpm) | 2422 | 2301 | 2878 |
| Carry (m) | 205.1 | 204.5 | 207.8 |
| Total distance (m) | 229.2 | 229.7 | 226.5 |
| Flight time (sec) | 5.61 | 5.54 | 5.94 |

As is apparent from the results in Table 4, because all the projections on the golf ball in Example 1 are raised projections, this ball had a much smaller surface area of contact at the time of impact, allowing it to achieve a high launch angle and low spin rate. Although this golf ball had a shorter carry than the ball in Comparative Example, it had a very long run, resulting in an increase in the total distance. Moreover, the flight time was short, indicating that the ball is less subject to wind effects.

In the golf ball of Example 2, the suitable interdispersion of recessed dimples and raised projections on the surface of the ball enables it to achieve an even higher launch angle and a lower spin rate than when all of the dimples are raised dimples as in Example 1.

Also, the raised projections provided on the golf balls in Examples 1 and 2 allowed the diameter of these balls in the land areas to be made smaller than the diameter specification for large-size balls (not less than 42.67 mm), giving balls which were less subject to wind effects and had straighter flight characteristics.

The golf balls of the present invention thus provide a straighter trajectory and a significantly increased run and total distance of travel.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball comprising a substantially spherical surface, a diameter in the land areas of not more than 42.66 mm, and a plurality of raised projections which are circular in planar shape and have a diameter of 1 to 4.2 mm and a height of at least 0.01 mm, wherein, 3 to 25 raised projections of at least two types different in diameter and/or height are contained in an imaginary circle with a radius of 5 mm traced on the spherical surface and centered at any point on said surface, and a diameter from a peak of one raised projection to a peak of another raised projection, positioned on the opposite side of the ball is not less than 42.67 mm.

2. The golf ball of claim 1, wherein the raised projections account for at least about 30% of the surface area of the imaginary circle.

3. The golf ball of claim 1, wherein the raised projections, when projected onto the spherical surface, have a total projected surface area that accounts for 30 to 90% of the overall surface area of the golf ball.

4. The golf ball of claim 1, which has a surface hardness of 50 to 70 in Shore D.

5. The golf ball of claim 1, wherein the raised projections are two to four types different in diameter and/or height.

6. The golf ball of claim 1, wherein the total number of raised projections is from 180 to 600.

7. The golf ball of claim 1, wherein said raised projections comprise all discontinuities from a spherical surface of the ball.

8. The golf ball of claim 1, wherein at least one type of the recessed dimples which are alike in shape are comprised within said imaginary circle.

9. The golf ball of claim 8, wherein said recessed dimples have a diameter in the range of 1.5 to 3.6 mm and a depth in the range of 0.08 to 0.20 mm.

10. The golf ball of claim 8, wherein the recessed dimples are of one to three types different in diameter and/or depth.

11. The golf ball of claim 8, wherein the number of the recessed dimples is 1 to 12 in the imaginary circle.

* * * * *